US008683923B2

(12) United States Patent
MacMahon et al.

(10) Patent No.: US 8,683,923 B2
(45) Date of Patent: Apr. 1, 2014

(54) AMUSEMENT RIDE

(75) Inventors: Patrick MacMahon, Singapore (SG); Philip Maddox, Singapore (SG)

(73) Assignee: Patrick Charles David Macmahon, Singapore (SG)

( * ) Notice: Subject to any disclaimer, the term of this patent is extended or adjusted under 35 U.S.C. 154(b) by 778 days.

(21) Appl. No.: 12/302,325

(22) PCT Filed: May 26, 2006

(86) PCT No.: PCT/SG2006/000132

§ 371 (c)(1), (2), (4) Date: Sep. 9, 2009

(87) PCT Pub. No.: WO2007/139508

PCT Pub. Date: Dec. 6, 2007

(65) Prior Publication Data

US 2009/0320712 A1 Dec. 31, 2009

(51) Int. Cl.
*A63G 1/00* (2006.01)
*A63G 7/00* (2006.01)

(52) U.S. Cl.
USPC ..... 104/57; 104/74

(58) Field of Classification Search
USPC ..... 104/53, 56, 57, 62–64, 67, 74–76, 89, 104/93, 118
See application file for complete search history.

(56) References Cited

U.S. PATENT DOCUMENTS

| | | | | | |
|---|---|---|---|---|---|
| 2,535,862 | A | * | 12/1950 | Pewitt | 472/30 |
| 3,610,160 | A | * | 10/1971 | Alimanestianu | 104/165 |
| 4,170,943 | A | * | 10/1979 | Achrekar | 104/56 |
| 4,491,073 | A | | 1/1985 | Dozer | |
| 4,603,638 | A | * | 8/1986 | Dozer | 104/95 |
| 5,372,072 | A | * | 12/1994 | Hamy | 104/93 |
| 5,527,221 | A | | 6/1996 | Brown et al. | |
| 6,098,549 | A | | 8/2000 | Mares | |
| 6,269,749 | B1 | * | 8/2001 | Hogg | 104/53 |
| 2003/0172834 | A1 | | 9/2003 | De-Gol | |

FOREIGN PATENT DOCUMENTS

| | | | |
|---|---|---|---|
| RU | 2142841 | C1 | 12/1999 |
| RU | 2214851 | C1 | 10/2003 |
| WO | WO-03/082421 | A2 | 10/2003 |

* cited by examiner

*Primary Examiner* — R. J. McCarry, Jr.
(74) *Attorney, Agent, or Firm* — Alston & Bird LLP

(57) ABSTRACT

A carriage assembly for mounting to a track following a curvilinear path, said assembly comprising a trolley mountable to said track through a track engagement assembly, an orientation of the trolley varying with an orientation of the track; a carriage rotationally mounted to the trolley, such that the carriage is free to rotate about two axes relative to the trolley, wherein rotation about the two axes maintains the carriage in a horizontal orientation independent of the orientation of the track.

18 Claims, 10 Drawing Sheets

AMUSEMENT RIDE

CROSS REFERENCE TO RELATED APPLICATIONS

This application is a 35 U.S.C. 371 national phase application of International Application No. PCT/SG2006/000132, filed May 26, 2006, which International Application was published by the International Bureau in English on Dec. 6, 2007, and which is incorporated herein by reference in its entirety.

FIELD OF INVENTION

The invention relates to amusement rides involving the loading of passengers within carriages which ascend and descend slowly. In particular, the invention relates to those amusement rides intended to provide moving observation platforms such as Ferris Wheels and theme park rotary viewing towers.

BACKGROUND

Amusement rides may fall into several broad categories. These include thrill rides whereby passengers are accelerated and decelerated at relatively high rates and subjected to varying degrees of disorientation for instance, roller coasters. A further category includes rides which act as moving observation platforms, with the classical description including the category of Ferris Wheels. In this category, the speeds at which the occupants are moved are far gentler and are generally intended to provide scenic views during the ride as against an adrenaline induced experience, as with roller coasters.

By their nature, viewing platform rides provide an acceptable field of view lateral to the plane of the ride, but for a significant duration of the ride, provide an obscured field of view within the plane of the ride. Further, where the carriages of the ride are of a more extensive size, such as to carry more than five people, the seating arrangements for an individual occupant may be such that the field of view is further obscured.

Further still, the occupant's field of view during the ride does not change in the horizontal direction, varying only in height as the carriage ascends. It follows that, for an extended duration, the occupant may become disinterested in the unchanging landscape and so detracting from the experience.

Economically, a factor in determining the popularity of such rides is the height of the ride. Against this must be balanced the significant construction costs, which lead to higher ticket prices. In order to maximize the appeal to the target audience, and so as to justify the higher price, an enhanced visual experience must be offered so as to differentiate the ride from other observation rides.

It would therefore be advantageous if such a ride could provide both an enhanced visual experience, whilst controlling the construction costs associated with the height of the ride.

STATEMENT OF INVENTION

In a first aspect the invention provides a carriage assembly for mounting to a track following a curvilinear path, said assembly comprising a trolley mountable to said track through a track engagement assembly, an orientation of the trolley varying with an orientation of the track; a carriage support rotationally mounted to the trolley, using a first rotational means, so as to permit rotation of the carriage support about a first axis relative to the trolley; a carriage rotationally mounted to the carriage support, using a second rotational means, so as to permit rotation of the carriage about a second axis relative to the carriage support, wherein rotation about the first and second axis maintains the carriage in an horizontal orientation independent of the orientation of the track.

In a second aspect, the invention provides an amusement ride comprising a curvilinear track; a plurality of carriage assemblies in movable engagement with said track, said carriage assemblies being in spaced relation to each along said track; a drive means for driving the plurality of carriages about the track whilst maintaining the movable engagement; said track defining a helical path about a longitudinal axis of the track such that the carriages, when driven along the track follow the helical path. In a third aspect, the invention provides a carriage assembly for mounting to a track following a curvilinear path, said assembly comprising a trolley mountable to said track through a track engagement assembly, an orientation of the trolley varying with an orientation of the track; a carriage rotationally mounted to the trolley, such that the carriage is free to rotate about two axes relative to the trolley, wherein rotation about the two axes maintains the carriage in an horizontal orientation independent of the orientation of the track.

In a third aspect, the invention provides A carriage assembly for mounting to a track following a curvilinear path, said assembly comprising a trolley mountable to said track through a track engagement assembly, an orientation of the trolley varying with an orientation of the track; a carriage rotationally mounted to the trolley, such that the carriage is free to rotate about two axes relative to the trolley, wherein rotation about the two axes maintains the carriage in a horizontal orientation independent of the orientation of the track.

Thus, the invention provides for the carriage to move about multiple axes and thus shift the position of each occupant's field of view throughout the duration of the ride. In so doing, instead of limiting the field of view, in fact, the occupant will maintain a continually shifting field of view in a range of different directions.

In differentiating the ride from the "thrill" rides as previously described, the invention aims to maintain the horizontal orientation of the carriage, such that an occupant sitting or standing within the carriage is not subjected to disorientation detract from the principle of the ride. In defining the term "horizontal", it is intended that the floor of the cabin of the carriage is level such that an occupant may stand comfortably and not feel unstable due to the motion of the carriage.

Further, by permitting the carriage to rotate about two axes, independent of the track, the occupants of the carriage will have a continuously changing field of view for the duration of the ride. This dynamic view will be considerably more interesting than the unchanging field of view of the conventional Ferris Wheel, and so enhancing the visual experience without increasing the height of the ride.

To further differentiate this ride from roller-coaster type ride reference is made to that shown in U.S. Pat. No. 4,170,943, the contents of which are incorporated. It will be noted that in this case the ride provides a multiple axis assembly. However, the assembly is incapable of maintaining the carriage in a stable horizontal orientation. In fact the ride is intended to disorient the occupants by shifting the orientation of the carriage as it follows a curved linear path. Whilst achieving the result of an adrenaline-induced ride, it does not provide scope for a stable viewing platform that is required of the present invention. In fact, the double axis arrangement of U.S. Pat. No. 4,170,943 could not be used for the intended purpose of the invention.

In a preferred embodiment, the first rotational means may include means to control the rotation between the trolley and carriage support. This may be particular advantageous to ensure the relative rotation does not lead to hazardous, or unappealing movement of the carriage in high winds or other external force. This control may be through dampening the rotation, adding superfluous gearing so as to increase the inertia required to cause free rotation, or more active control such as a motor or the like that may add a balancing force against the unwanted rotation. Such active control may require sensors, such as accelerometers and a central control unit that may sense the acceleration and either apply the force indiscriminately, or apply adequate force sufficient to balance the rotation.

In a preferred embodiment, the criteria to activate control may include rotational acceleration, rotational displacement from the horizontal orientation or rotational speed.

In a preferred embodiment, the second rotational means may be arranged such that the under the influence of gravity, the carriage is biased to the horizontal orientation.

In a preferred embodiment, the carriage support may include a yoke having a pair of coupling arms, said carriage coupled between the coupling arms through the second rotational means. In a more preferred embodiment, the second rotational means may further include a pair of pivot assemblies mounted adjacent to ends of each coupling arm.

In a further preferred embodiment, the pivot assemblies may each comprise an axle engaged with a bearing assembly, said pivot assemblies being in communication with a rotational damping device.

In an alternative embodiment, the carriage support may include a two or more arcuate members or rings, which at least partially encircle the carriage, such that the carriage within the rings can rotate about the second axis. Further, the rings may include rails to match with rails or runners on the carriage to permit controlled relative movement about the second axis. n a still further embodiment, the rings and/or runners of the carriage may be powered to control rotation of the carriage.

In a preferred embodiment, the track may comprise a structural element having a curvilinear shape. Further, the curvilinear shape may define a helical path about a longitudinal axis of the track.

Further still, the track may have an overall shape, either closed or open. Said closed shape may be a circle or ellipse. An open shape may include a parabola. Alternatively, the track may have a more complex amorphous shape, defined by the overall requirements of the ride.

In a preferred embodiment, the angular path followed by the helical path may be a multiple of 180°.

BRIEF DESCRIPTION OF DRAWINGS

It will be convenient to further describe the present invention with respect to the accompanying drawings which illustrate possible arrangements of the invention. Other arrangements of the invention are possible and consequently the particularity of the accompanying drawings is not to be understood as superseding the generality of the preceding description of the invention.

DESCRIPTION OF PREFERRED EMBODIMENT

Figure 1:
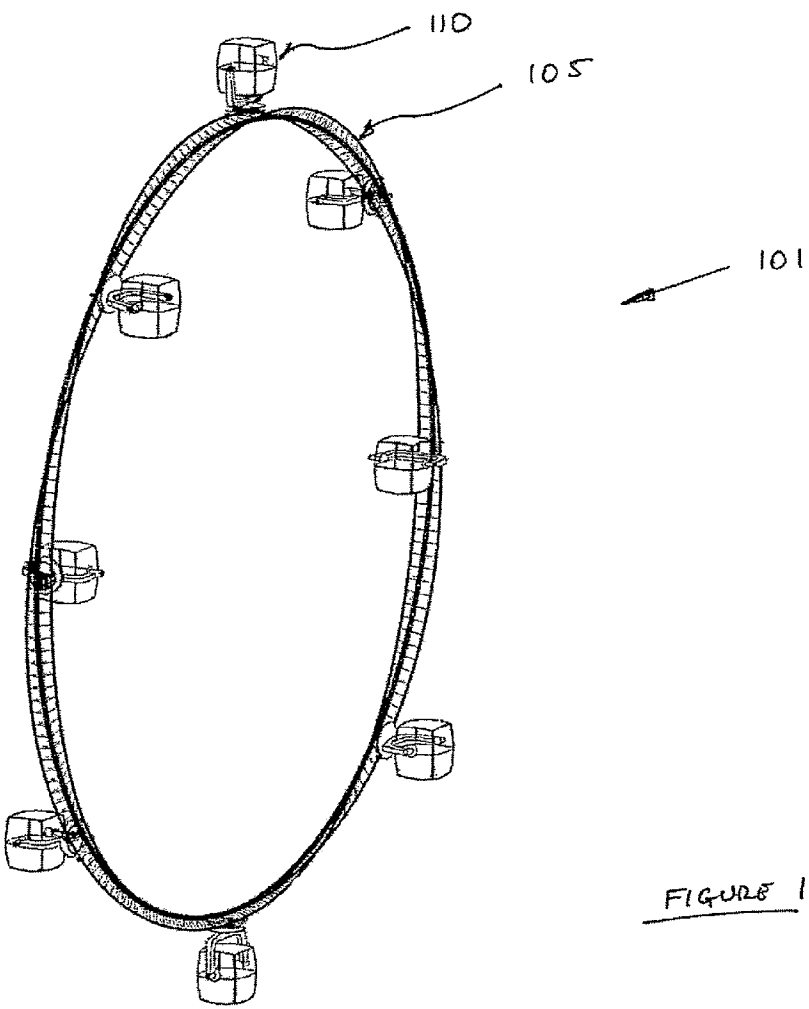
FIG. 1 is an isometric view of the amusement ride according to one embodiment of the present invention.

The amusement ride 101 according to one embodiment of the present invention may be realised as a structure 101 comprising a large diameter circle 105 incorporating a track about which a carriage 110 may travel along. More particularly the structure 101 may follow a helical path about a longitudinal axis of the track which in this case of a closed loop 105. To maximize the functionality of the wheel, several carriages 110 may be dispersed about the wheel 105 so as to continually provide paying customers with the desired ride.

To be described in more detail below, the intent of the invention is to provide an enhanced field of view for the occupants of each carriage 110 as it travels about the track 105. Because of the helical nature of the track, however, it is necessary to maintain the carriage in a stable horizontal orientation such that an occupant may sit or stand without fear of falling or stumbling. Thus, the invention is differentiated from adrenalin-induced rides where maintaining a stable horizontal orientation is, in fact, a goal that is to be avoided. As an example but without seeking to limit the scope of the invention, an operational speed of a carriage whilst traversing the track, may be typically no greater than two meters per second and so avoiding excessive accelerations applied to the occupants.

Figure 2:
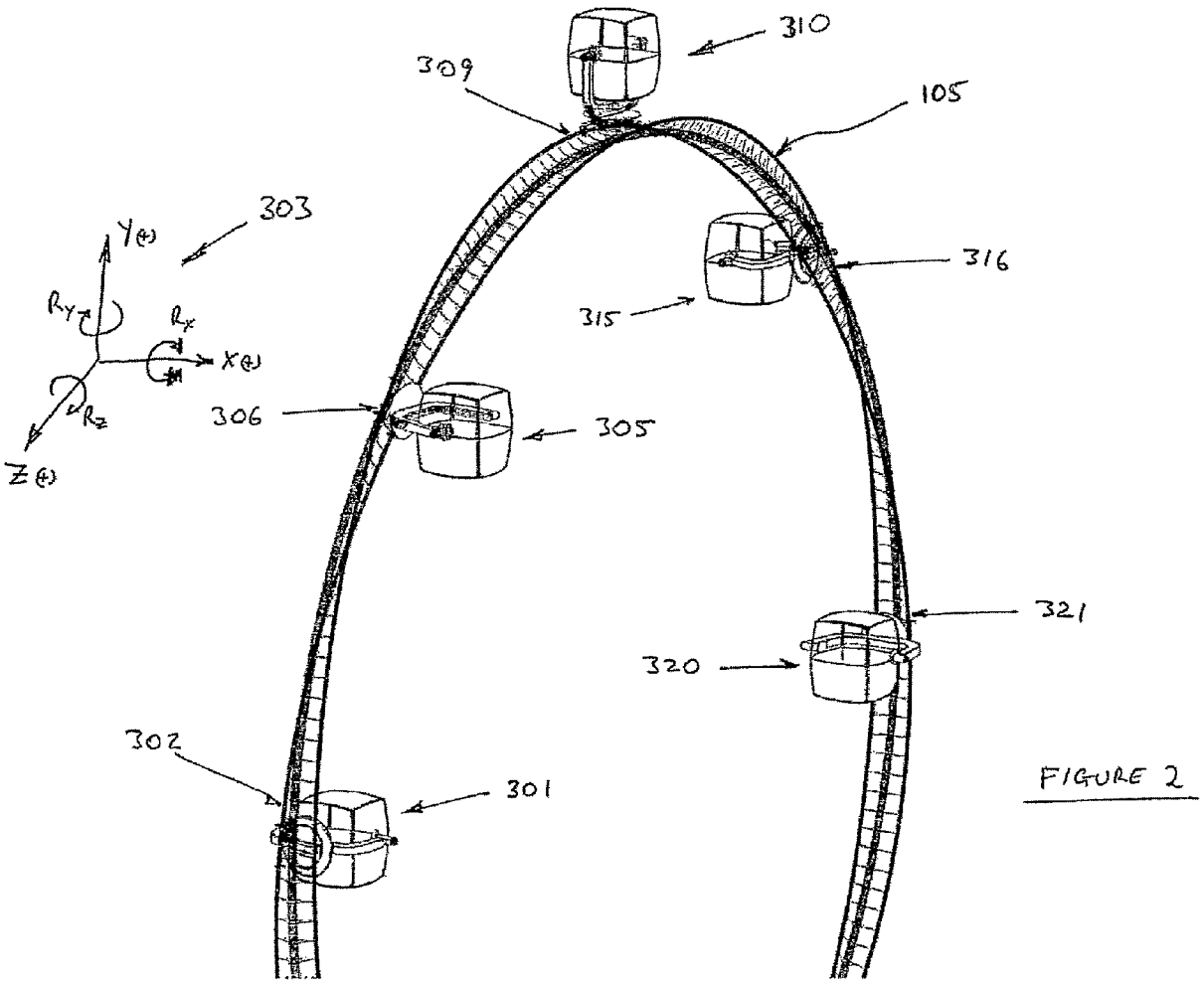
FIG. 2 is a detail view of the amusement ride of FIG. 1.

FIG. 2 shows a detailed view of the ride as shown in FIG. 1.

Five carriages 301, 305, 310, 315, 320 are shown at various stages 302, 306, 309, 316, 321 along a portion of the track 105. The helical path followed by the track 105 is more evident from the changing orientation of each of the carriages at the various stages along the track 105.

To gain an appreciation for the movement of the carriages about the track 105, a coordinate system 303 is provided as a means of identifying the location of the carriage going from one stage to the next. For instance, for the carriage 301 to move to the next stage 302 to 306 requires a rotation about the Y axis (Ry) so that the carriage is directed away from the Z (−) direction to the X (+) direction. Consequently moving to the next stage 306 to 309 requires a rotation of the carriage about the Z axis (Rz). As the carriage progresses to the next stage 309 to 316, a further rotation about the Z axis (Rz) such that the carriage is now directed in the X (−) direction. And a still further movement to the next stage 316 to 321 requires a rotation about the Y axis (Ry) so as to now direct the carriage in the Z (+) direction.

It will be appreciated that the detail as shown in FIG. 2 shows the upper portion only of the amusement ride and further rotation of the carriage from stage 321 through the lower half to stage 302 will result in a reverse rotation so as to match the position of carriage 301.

In considering the rotation of the carriage, the means by which the carriage is able to rotate is yet to be discussed but will be shown below. Further no appreciation for the change in internal orientation of the carriage has been considered but it will be appreciated that whilst in stage 309 opposed sides of the carriage have an unrestricted view whereas going from stages 302, 306 to stages 316, 321 require a change in rotation such that one side will have an unrestricted view compared with the opposed side closest to the track, and that these positions will be swapped so as to share the available viewing access.

Figure 3:
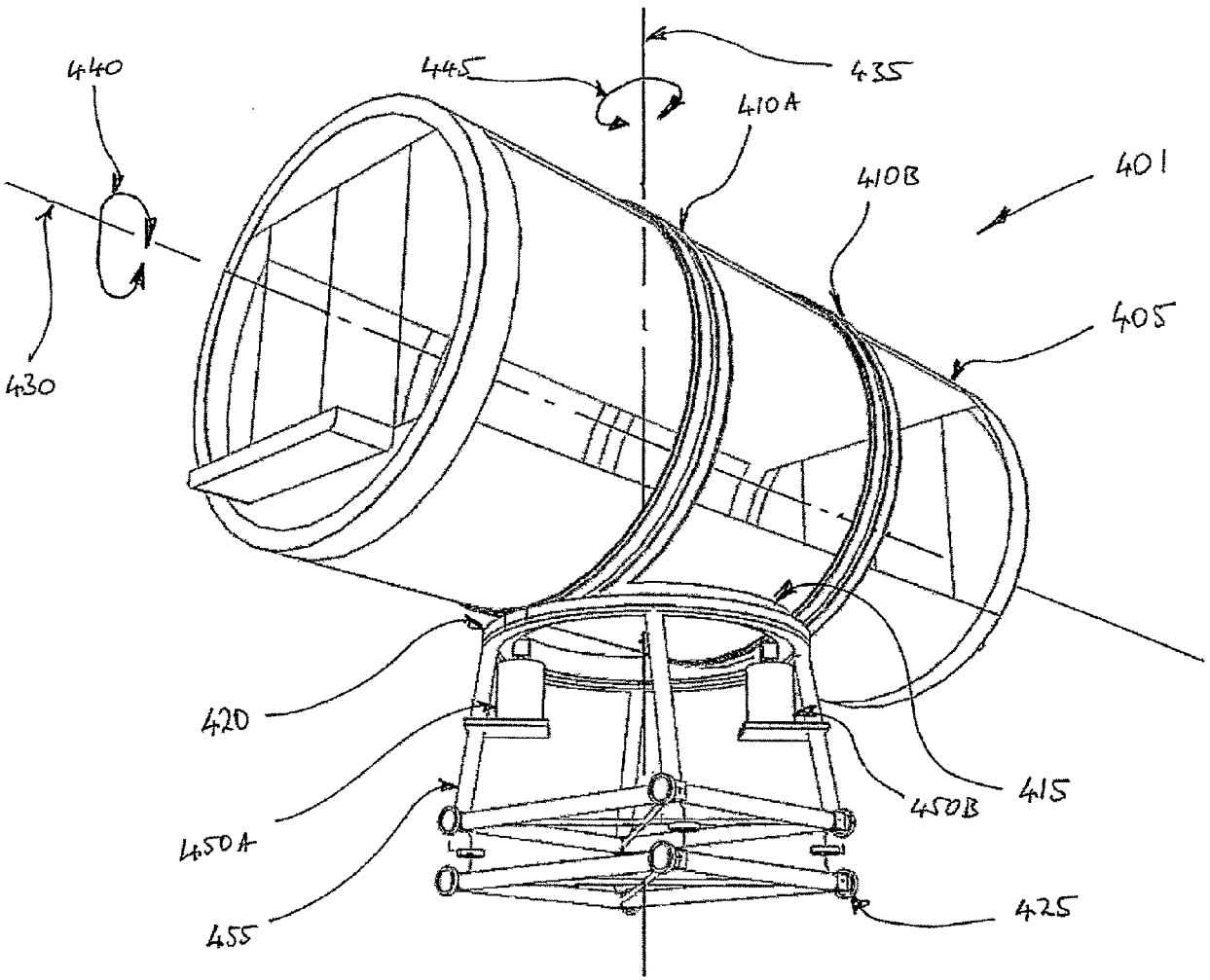
FIG. 3 is an isometric view of a carriage according to a further embodiment of the present invention.

FIG. 3 shows one embodiment of the carriage 401 according to the present invention. Here the cabin 405 is substantially cylindrical in shape and is intended to hold in excess of 10 occupants, providing both standing and seated positions. The cabin 405 is bound by two arcuate members 410A,B, or rings. There exists a rotational engagement between the rings 410A,B and the cabin 405, provided by complimentary rails between the rings and cabin. The complimentary rails form a $2^{nd}$ rotational means permitting relative rotation 440 of the cabin within the rings about an axis 430.

The rings 410A,B further link the cabin to a trolley 422. The trolley 422 includes a $1^{st}$ rotational means 415, 420 being an intermeshed gear arrangement with an internal ring gear 415 mounted between the cabin 405 and an outer ring gear 420, which is mounted to the trolley 422. Thus, the cabin 405 is able to rotate 445 about an axis 435, relative to the trolley 422, via this gear arrangement 415, 420.

The trolley 422 further includes a frame 455 separating the $1^{st}$ rotational means 415, 420 from the track engagement portions 425. In this embodiment, the track engagement portions 425 include four sets of rollers adapted to engage the track (not shown). The trolley may then be driven, such as by a chain, belt or other drive means about the track, with the cabin 405 able to rotate about the two axes 430, 435 to maintain the horizontal orientation. To control the rotation of the $1^{st}$ and $2^{nd}$ rotational means, said assemblies may include damping or rotational control devices. In this embodiment, the cabin/ring engagement may be in communication with a damping device, such as a rotational damper in parallel with the rings 410A,B. The $1^{st}$ rotational means, in this embodiment, includes the gear arrangement 415, 420 having two damping devices 450A,B in contact with the inner ring gear 415. As the rotational speed of the inner gear 415 increases, the effect is dampened through vanes rotating in a viscous liquid within the damping devices. The design of either of such damping devices will be a matter of routine for the skilled addressee.

Figure 4A:
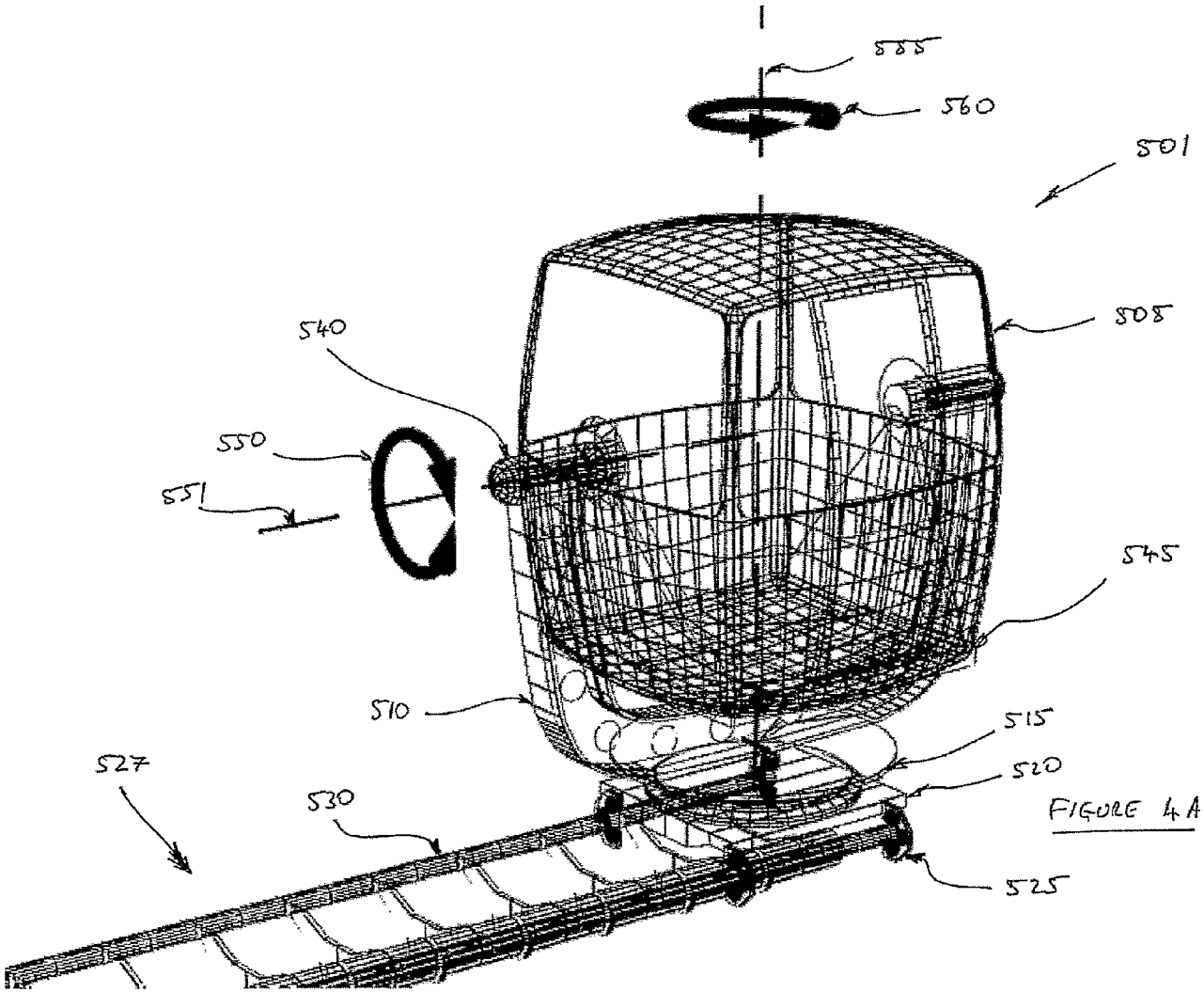
FIG. 4A is an isometric view of a carriage according to further fourth embodiment of the present invention.
Figure 4B:
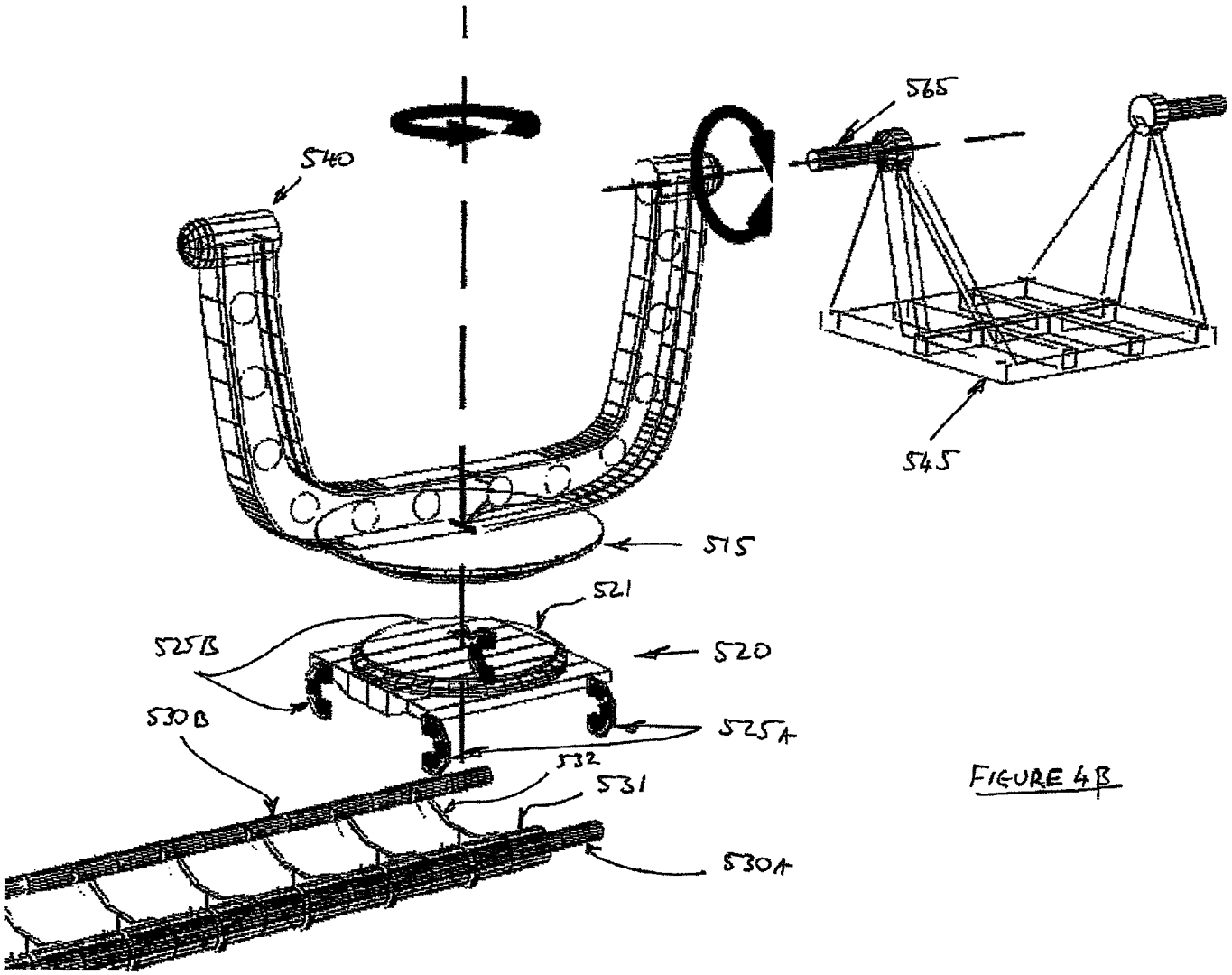
FIG. 4B is an exploded view of the carriage of FIG. 4A.

FIGS. 4A and 4B provide detail views of the carriage according to the embodiment shown in FIGS. 1 and 2. Here there is shown a carriage 501 comprising a cabin 505 down to the point of cradle 545. The cradle is rotationally mounted to a yoke 510 through a pair of pivotal mounting points 540. The axis 551 defining this pivotal mounting provides for a rotation 550.

The yoke 510 is mounted upon a plate 515, via a slew ring bearing assembly 521, which is engaged with a further assembly 520. The plate 515 and assembly 520 are mounted so as to be concentric with a perpendicular axis passing through this centre the cabin 505 define the axis of rotation 560 about which the yoke 510 will rotate.

This assembly 515, 520 is further mounted to a trolley which is in turn mounted through rail attachments brackets 525 to the track rail 530 of the track 527.

Further defining the assembly of the carriage 501, the exploded view shown in FIG. 4B shows the cradle 545 having rotational pins 565 which are insertable within rotational brackets 540.

With reference to the track 527, in this embodiment the track 527 comprises a pair of rails 530A, 530B mounted about a central spine 531 through periodic gusset plates 532 forming the track 527 into a continuous rigid structural member.

Figure 5A:
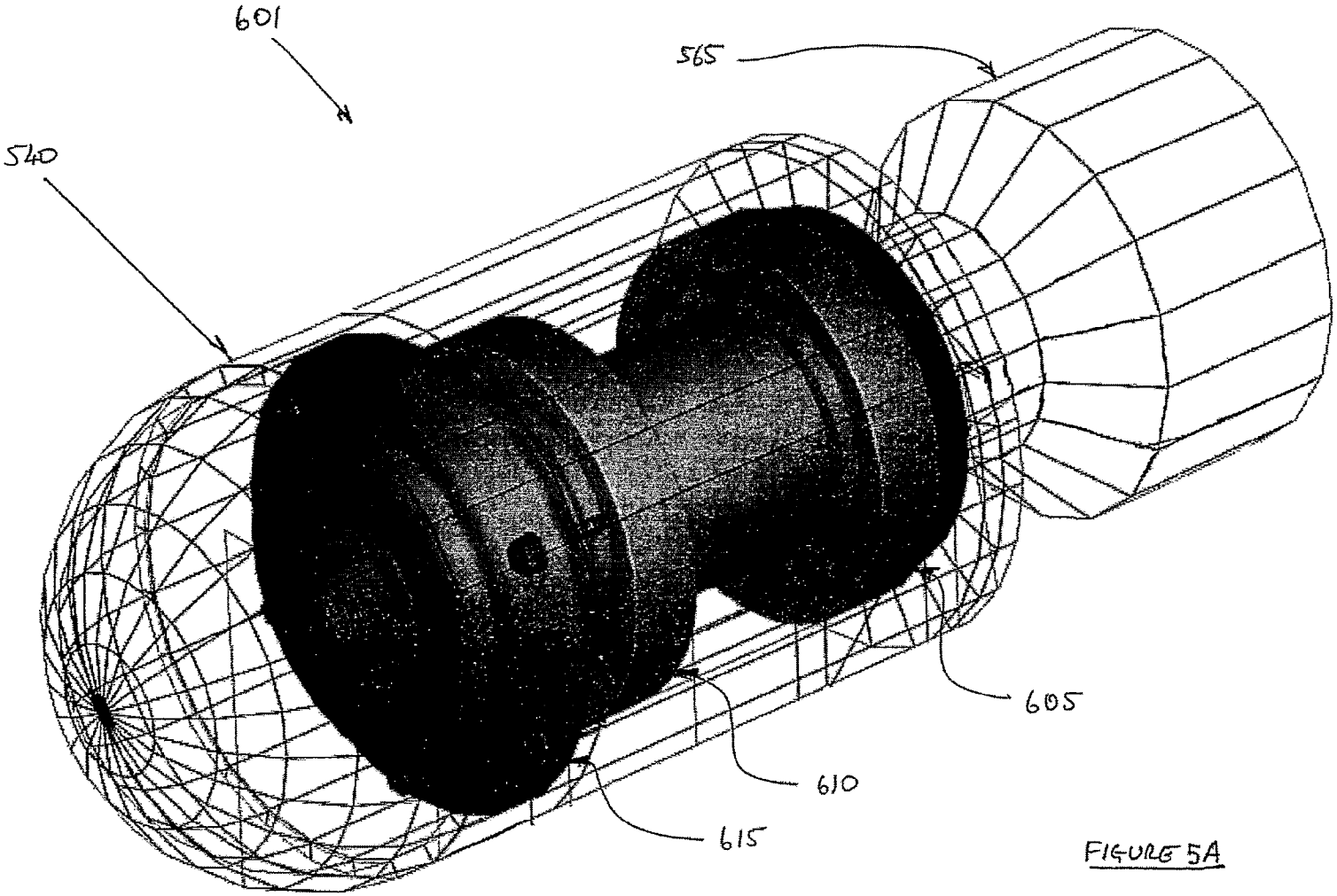
FIG. 5A is a detail view of the second rotational means according to a further embodiment of the present invention.
Figure 5B:
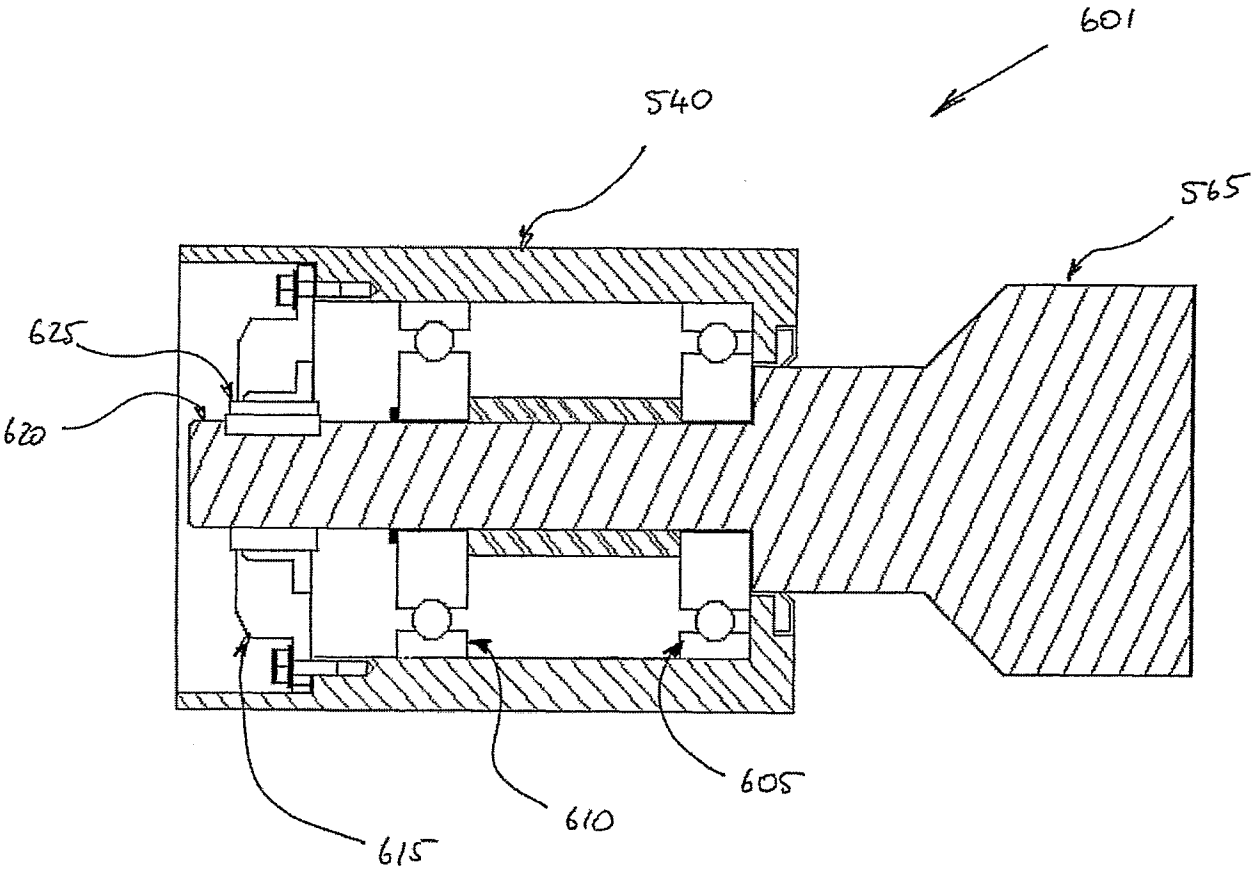
FIG. 5B is a sectional elevation view of the second rotational means of FIG. 5A.

FIGS. 5A and 5B show various views of the second rotational means 601 which is used to provide rotation of the cradle 545 about the yoke 510. This is achieved by the cradle 545 having a pair of axles 565 projecting outwards and adapted to engage the rotational bracket 540 mounted to the yoke 510. The axle 565 includes an elongate projection 620 which is inserted within the rotational bracket 540 about which the cradle 545 rotates. The projection 620 engages two bearings, the first 605 being a bearing to control both rotation and axle movement of the axle 565 and the second 610 being purely rotational with both bearings 605, 610 acting to control the movement of the cradle 545 in a purely rotational movement. The projection 620 further includes a key 625 at a distal end of said projection 620 which engages with a rotational damping means 615. Thus to prevent the cradle 545 undergoing an uncontrolled rotation which may lead to an instability for the occupants should the carriage be subjected to a wind load, the rotation of the carriage is controlled by the rotational damping means 615 so as to minimize this uncontrolled rotation and provide a smooth ride for the occupants.

Figure 6A:
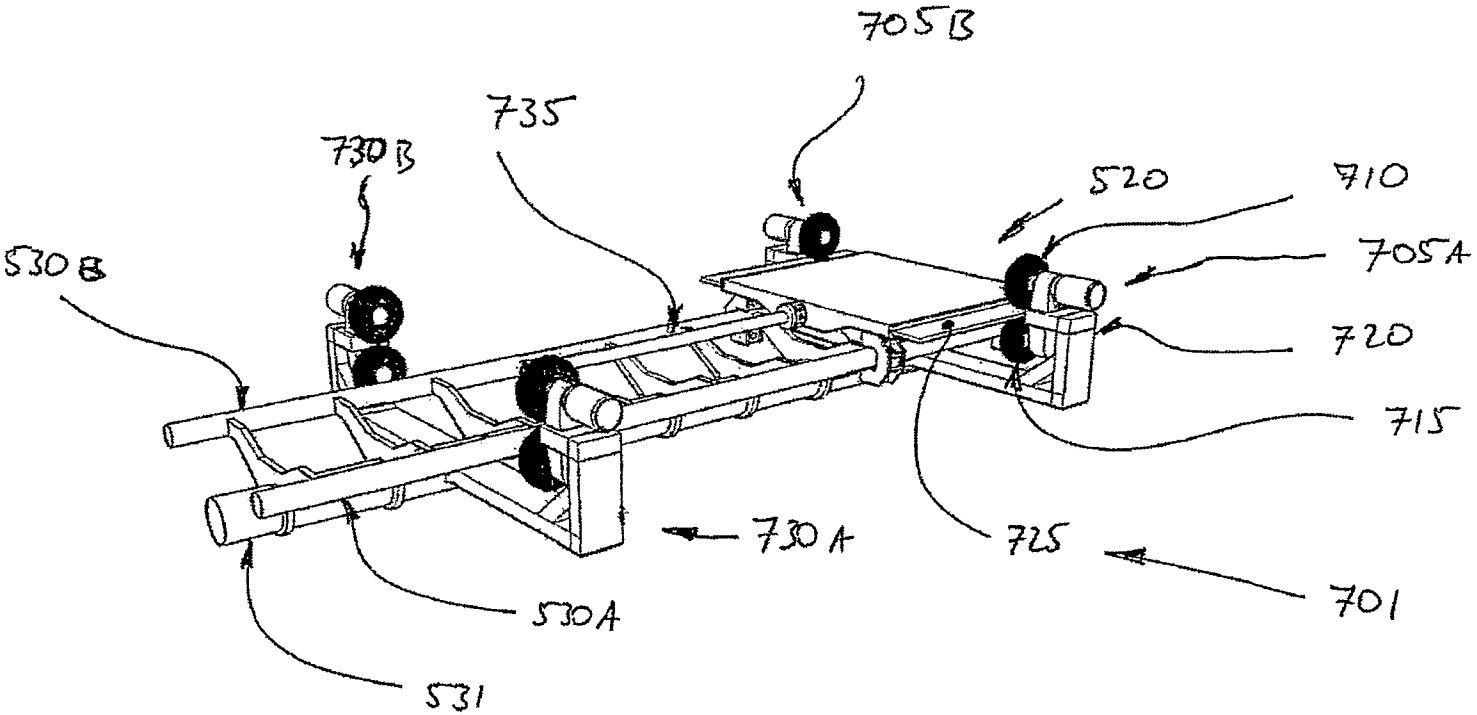
FIG. 6A is an isometric view of the drive system according to a further embodiment of the present invention.
Figure 6B:
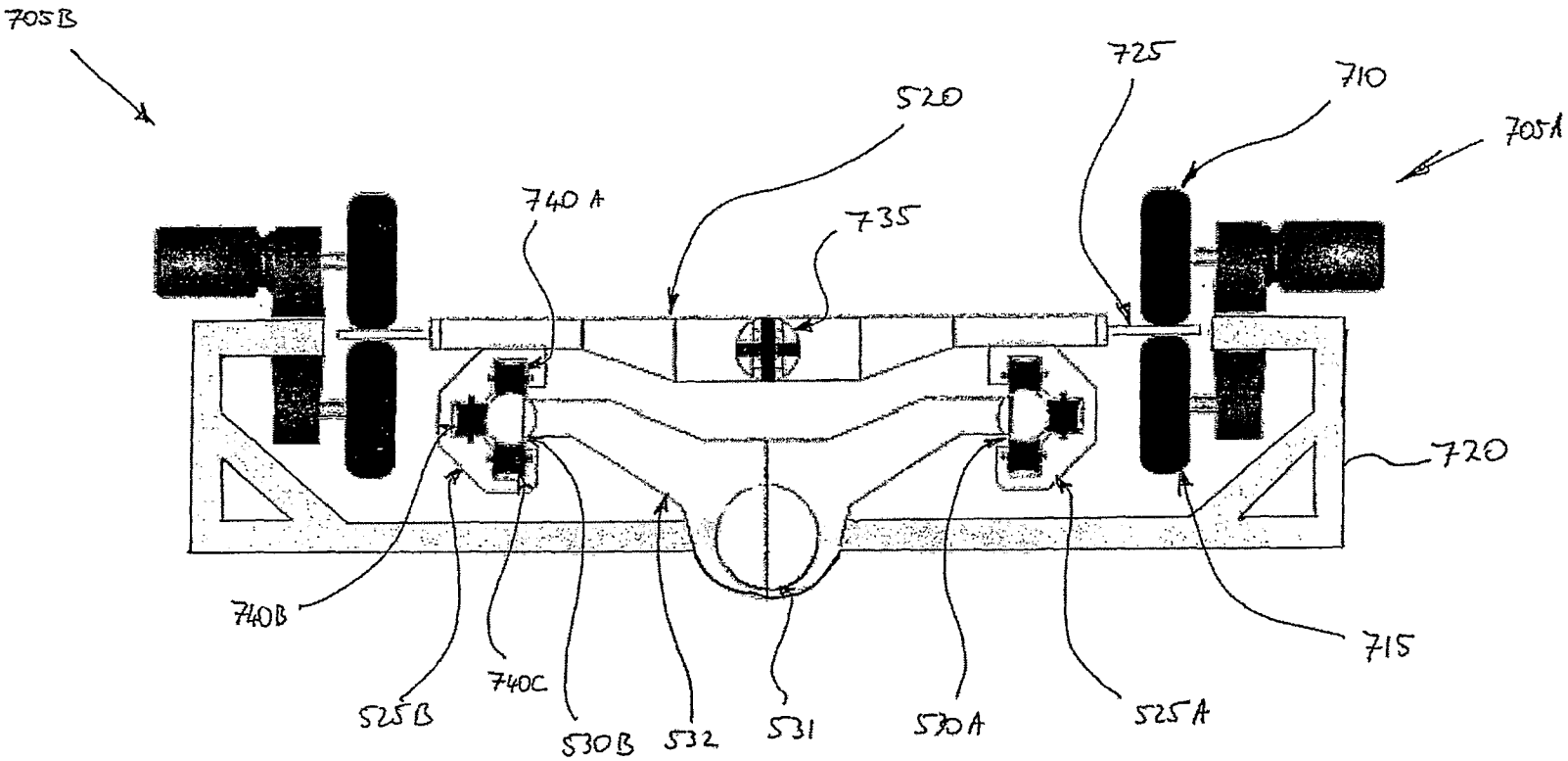
FIG. 6B is a front elevation view of the drive system of FIG. 6A.
Figure 7:
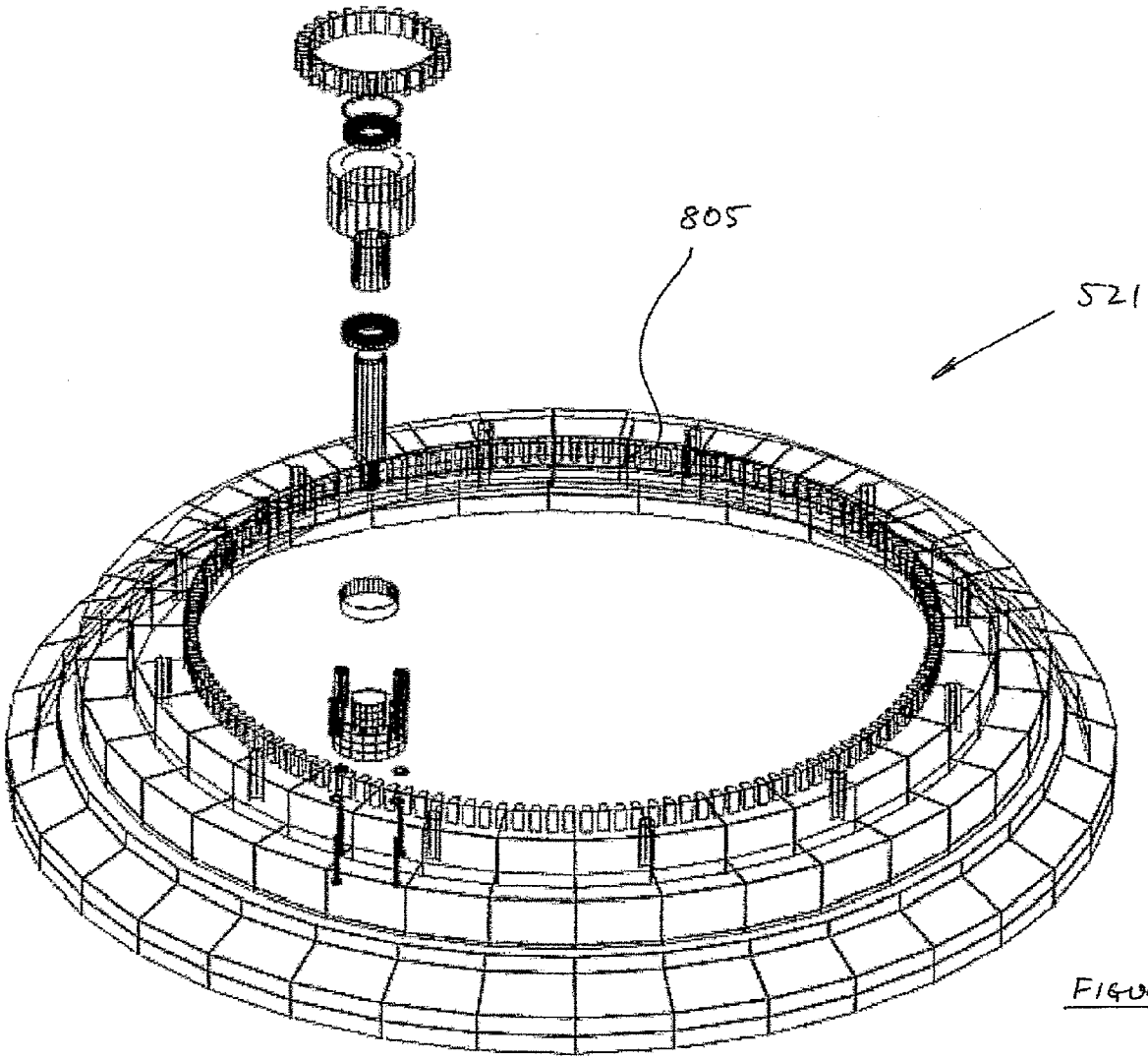
FIG. 7 is an exploded view of the first rotational means according to a further embodiment of the present invention.

FIGS. 6A and 6B show one embodiment of a drive system applicable to the invention. The drive system of FIGS. 6A and 6B involve discreet pairs of pinch rollers 705A,B and 730A,B which may be placed periodically about the track so as to drive the carriages. In this case, the carriage has been removed for clarity and leaving the trolley 520 as representative of the carriage. It will be noted that the trolley 520 includes elongate projections or wings 725 on either side of the trolley 520 which comprise metal strips of sufficient thickness to fit between the drive rollers 710, 715 of the pinch rollers 705A. In this case the rollers 710, 715 may be a high duro rubber or polyurethane which contact the wing 725 in a pinch roller arrangement and so impart drive to the carriage through friction. The drive motor used to drive the pinch roller 705A,B may be operated using a number of different means including a hydraulic motor or electric motor, the motors located to operate each pair separately, or a central motor operating all or some of the rollers collectively, using a chain or belt drive (not shown). It will be appreciated by the skilled addressee that a number of different drive means could be used in addition to the ones listed. The arrangement of such drive motors to provide the drive through the drive rollers 705A,B will be a matter of a routine.

In this case the drive rollers 705A,B are located on either side of the track supported by brackets 720 mounted to the tracks 531 and so tied to the structural portion of the track. Each trolley 520 will be connected to adjacent trolleys through rod 735 so as to maintain the space relation between the carriages and also to distribute the drive force between said carriages and so more evenly distribute the drive requirement about the periodically placed pairs of drive rollers 505A, B. In cases where the radius of the track is small, or where it would be beneficial to avoid warping of the rod, "dummy" trolleys (not shown) may be used intermediate the carriages so as to extend the distance between carriages, so as to maintain the integrity of the rods.

Further attached to the trolley 520 are the track engagement brackets 525A,B which engage the track through in this case a three roller assembly 740A,B,C which group the track about the periphery of the track 530A,B a side opposed to the supporting gusset plates 532.

FIG. 8 shows alternative arrangement for the first rotational means 221 mounted to the trolley 520. In this case the portion mounted to the yoke includes an internal gear to fit with the gear 805. Rotation is therefore controlled through a damper or a initial gear arrangement to ensure a controlled rotation of the carriage about the trolley through the axis 555.

The invention claimed is:

1. A carriage assembly for mounting to a track defining a helical path about a longitudinal axis of the track, said assembly comprising:

a single trolley mountable to said track through a track engagement assembly, an orientation of the trolley varying with an orientation of the track;

a carriage support rotationally mounted to the trolley, using a first rotational means, so as to permit rotation of the carriage support about a first axis relative to the trolley; and a carriage rotationally mounted to the carriage support, using a second rotational means, so as to permit rotation of the carriage about a second axis relative to the carriage support, wherein the carriage is configured to be engaged with the track via said one single trolley, wherein the second rotational means is arranged such that under the influence of gravity, the carriage is biased to a horizontal orientation, and rotation about the first and second axes is arranged to maintain the carriage in the horizontal orientation independent of the orientation of the track.

2. The assembly according to claim 1, wherein the horizontal orientation of the carriage is maintained throughout the duration of travel along the helical path.

3. The assembly according to claim 1, wherein the first rotational means comprise a carriage support engagement member mutually engaged with a trolley engagement member, said first rotational means further including a control means for controlling the relative rotation and/or rotational speed between the trolley and carriage support.

4. The assembly according to claim 3, wherein the control means comprise the engagement members having intermeshing gears in communication with a damping means for damping the forces applied to the carriage assembly.

5. The assembly according to claim 3, wherein the control means comprise the engagement members having intermeshing gears in communication with an actuation means, said actuation means for applying a predetermined force to the carriage assembly to maintain the horizontal orientation, through the intermeshing gears subject to exceeding predetermined criteria, said criteria including any one or a combination of: rotational acceleration, rotational displacement from the horizontal orientation and rotational speed.

6. The assembly according to claim 2, wherein the control means comprises rotational damping means so as to minimize uncontrolled rotation of the carriage.

7. The assembly according to claim 1, wherein the carriage support comprises a yoke having a pair of coupling arms, said carriage coupled between the coupling arms through the second rotational means.

8. The assembly according to claim 7, wherein said second rotational means comprising a pair of pivot assemblies mounted adjacent to ends of each coupling arm.

9. The assembly according to claim 8, wherein the pivot assemblies each comprise an axle engaged with a bearing assembly, said pivot assemblies being in communication with a rotational damping device.

10. The assembly according to claim 1, wherein said first and second axes are orthogonal to each other.

11. The assembly according to claim 1, wherein the carriage support comprises a plurality of arcuate members, said arcuate members at least partially encircling the carriage, said second rotational means facilitating rotation of the carriage within said arcuate members.

12. The assembly according to claim 11, wherein the rotational means comprise complimentary rails between the arcuate members and the carriage to permit controlled relative movement about the second axis.

13. An amusement ride comprising:

a curvilinear track;

a plurality of carriage assemblies in movable engagement with said track, said carriage assemblies being in spaced relation to each along said track;

a drive means for driving the plurality of carriages about the track whilst maintaining the movable engagement; and said track defining a helical path about a longitudinal axis of the track such that the carriages, when driven along the track follow the helical path, wherein each one of the carriage assemblies includes one single trolley through which the carriage assemblies are engaged with the track, each one of said carriage assemblies further including a carriage rotatable about two discrete axes relative to said one single trolley, and rotation about one of the axes is arranged such that under the influence of gravity, the carriage is biased to a horizontal orientation, and rotation about the two discrete axes is arranged to maintain the carriage in a horizontal orientation whilst moving along said helical path.

14. The amusement ride according to claim 13, wherein the horizontal orientation permits occupants of said carriage to remain upright.

15. The amusement ride according to claim 13, wherein the angular path followed by the helical path is a multiple of 180°.

16. The amusement ride according to claim 13, wherein the track follows a closed path.

17. The amusement ride according to claim 13, wherein each one of the carriage assemblies comprises:

a single trolley mountable to said track through a track engagement assembly, an orientation of the trolley varying with an orientation of the track;

a carriage support rotationally mounted to the trolley, using a first rotational means, so as to permit rotation of the carriage support about a first axis relative to the trolley; and a carriage rotationally mounted to the carriage support, using a second rotational means, so as to permit rotation of the carriage about a second axis relative to the carriage support, wherein the carriage is configured to be engaged with the track via said one single trolley, wherein rotation about the second rotational means is arranged such that under the influence of gravity, the carriage is biased to a horizontal orientation, and rotation about the first and second axes is arranged to maintain the carriage in the horizontal orientation independent of the orientation of the track.

18. A carriage assembly for mounting to a track defining a helical path about a longitudinal axis of the track, said assembly comprising:

a single trolley mountable to said track through a track engagement assembly, an orientation of the trolley varying with an orientation of the track; and a carriage rotationally mounted to the said one single trolley, such that the carriage is free to rotate about two axes relative to the trolley, wherein rotation about one of the axes is arranged such that under the influence of gravity, the carriage is biased to a horizontal orientation, and rotation about the two axes is arranged to maintain the carriage in the horizontal orientation independent of the orientation of the track.

* * * * *